United States Patent [19]

Walton

[11] Patent Number: 4,567,623

[45] Date of Patent: Feb. 4, 1986

[54] LEAF AND DEBRIS COLLECTOR

[76] Inventor: John H. Walton, 1000 Mt. Vernon Ave., Haddonfield, N.J. 08033

[21] Appl. No.: 654,423

[22] Filed: Sep. 26, 1984

[51] Int. Cl.[4] ..... A47L 9/14

[52] U.S. Cl. ..... 15/337; 15/340; 15/352; 83/660

[58] Field of Search ..... 15/340, 352, 337

[56] References Cited

U.S. PATENT DOCUMENTS

| | | | |
|---|---|---|---|
| 3,147,510 | 9/1964 | Thompson | 15/337 |
| 3,241,173 | 3/1966 | Finn | 15/328 |
| 3,460,185 | 8/1969 | Cook | 15/340 |
| 3,461,479 | 8/1969 | Tierney | 15/352 X |
| 3,710,412 | 1/1973 | Hollowell | 15/352 X |
| 3,790,986 | 2/1974 | Burger | 15/328 |
| 3,813,725 | 6/1974 | Rinker | 15/347 |
| 3,903,565 | 9/1975 | Hicks | 15/352 |
| 3,918,119 | 11/1975 | Sweet | 15/328 |
| 3,940,827 | 3/1976 | Greco | 15/328 |
| 3,968,938 | 7/1976 | Ruhl et al. | 15/337 X |
| 4,467,494 | 8/1984 | Jones | 15/352 X |

OTHER PUBLICATIONS

"Big Wind For The Backyard", Popular Science, vol. 22, #4, Apr. 1973, p. 87.

*Primary Examiner*—Chris K. Moore

*Attorney, Agent, or Firm*—Woodcock, Washburn, Kurtz, Mackiewicz & Norris

[57] ABSTRACT

An improved leaf and debris collection apparatus is described which features a centrifugal fan mounted on a wagon and driven by an engine, the inlet side of the fan being connected to an inlet head just above ground level and its outlet side connected to an outlet plenum, comprising an outlet port for attachment of a disposable bag. A punch is provided for punching a large number of holes in the disposable bag so that air pressure is not collected within, so that the disposable bag can be used to collect the leaves and debris. In a preferred embodiment, the plenum has holes formed therein for release of air pressure, and the bag is disposed vertically beneath the plenum.

4 Claims, 2 Drawing Figures

LEAF AND DEBRIS COLLECTOR

FIELD OF THE INVENTION

This invention relates to the field of machinery for collecting leaves and other debris from lawns, flower beds and the like. More particularly, the invention relates to a device for collecting leaves and other debris in which the debris is collected directly into a disposable bag so that no subsequent transfer of the collected debris need be made.

BACKGROUND OF THE INVENTION

Millions of homeowners are faced at least annually with the task of collecting up large quantities of leaves and other debris which collect on lawns, in flower beds and in shrubbery and the like, particularly during the fall season. This collection can be quite a strenuous task involving as it does the raking of leaves and other debris into piles and then putting the piles into disposable plastic trash bags. The latter is particularly troublesome and laborious because it is a difficult job to put a large quantity of debris into the bag while keeping the bag open without spilling any of the debris. Disposal of leaves by use of disposable bags is increasingly common due to the proliferation of antiburning ordinances. Accordingly, the art has seen the need for providing machinery to aid in this task. Examples of attempts at solving these problems are shown in numerous patents, for example U.S. Pat. Nos. 3,903,565 to Hicks, 3,241,173 to Finn, 3,790,986 to Burger, 3,940,827 to Greco, 3,918,119 to Sweet and 3,813,725 to Rinker. However, none of the devices shown in these patents are as useful as would be desired, due to a variety of deficiencies from which they suffer. For example, most of these collect the leaves and other debris in a permanent bag or canister, so that if the leaves and debris are to be bagged for municipal disposal or the like, the debris must then be transferred to a disposable bag for disposal. This is an extra manipulative step which can itself be messy and troublesome and is certainly undesirable. Rinker U.S. Pat. No. 3,813,725 shows collecting the leaves and debris in a disposable bag, but it is carried within a fixed bag. Therefore a clumsy removal operation is needed to separate the filled disposable bag from the fixed bag. Many of the designs shown in these patents only provide for a bag of relatively limited capacity which means that the pick up operation must proceed rather slowly. Further, the machinery typically used to vacuum up the leaves and debris and blow it into a bag or canister is relatively expensive and complex, so it would be desirable if this machinery could be used in as many ways and to perform as many different tasks as possible so as to enable its more efficient amortization.

OBJECTS OF THE INVENTION

It is therefore an object of the invention to provide an improved apparatus for collecting up leaves and other debris from lawns and the like and to directly deposit it into disposable bags, such that intermediate material handling steps are eliminated.

It is a further object of the invention to provide an apparatus for cleaning up leaves and other debris in which the machinery is sufficiently versatile that its mechanism can be used for other related purposes such as blowing or vacuuming leaves out of flower beds for ready collection.

It is a further object of the invention to provide a leaf collection device in combination with a tool for the ready punching of commercially available plastic, paper, or other disposable bags with a large number of small holes such that in use the bag itself is essentially depressurized, although air pressure is used to convey leaves and debris into the bag.

It is a further object of the invention to provide a device to shred leaves in preparation to making a leaf mulch that may be bagged, blown on to flower and garden beds, or into a mulch pile.

SUMMARY OF THE INVENTION

The present invention achieves the needs of the art and objects of the invention mentioned above by its provision of an improved debris collecting device which comprises a centrifugal blower driven by a prime mover such as a gasoline engine mounted on a wagon for moving about a lawn or the like. The input of the centrifugal blower is connected to a fixed pick up hood which vacuums up any debris over which it passes and its outlet is connected to a duct which in turn is connected to a port to which may be attached a perforated disposable bag. In the preferred embodiment, a disposable bag punch is mounted on the machine as well so that plastic bags can be punched as needed, thus simplifying the operation. Both the inlet and the outlet of the blower can be reconnected to flexible, movable hoses, for example to either remove debris from places inaccessible by the wagon, or to blow air as needed, e.g. to blow leaves across a lawn, out of flower beds, and the like into an accessible pile.

BRIEF DESCRIPTION OF THE DRAWINGS

The invention will be better understood if reference is made to the accompanying drawings in which.

DESCRIPTION OF THE PREFERRED EMBODIMENTS

Figure 1:
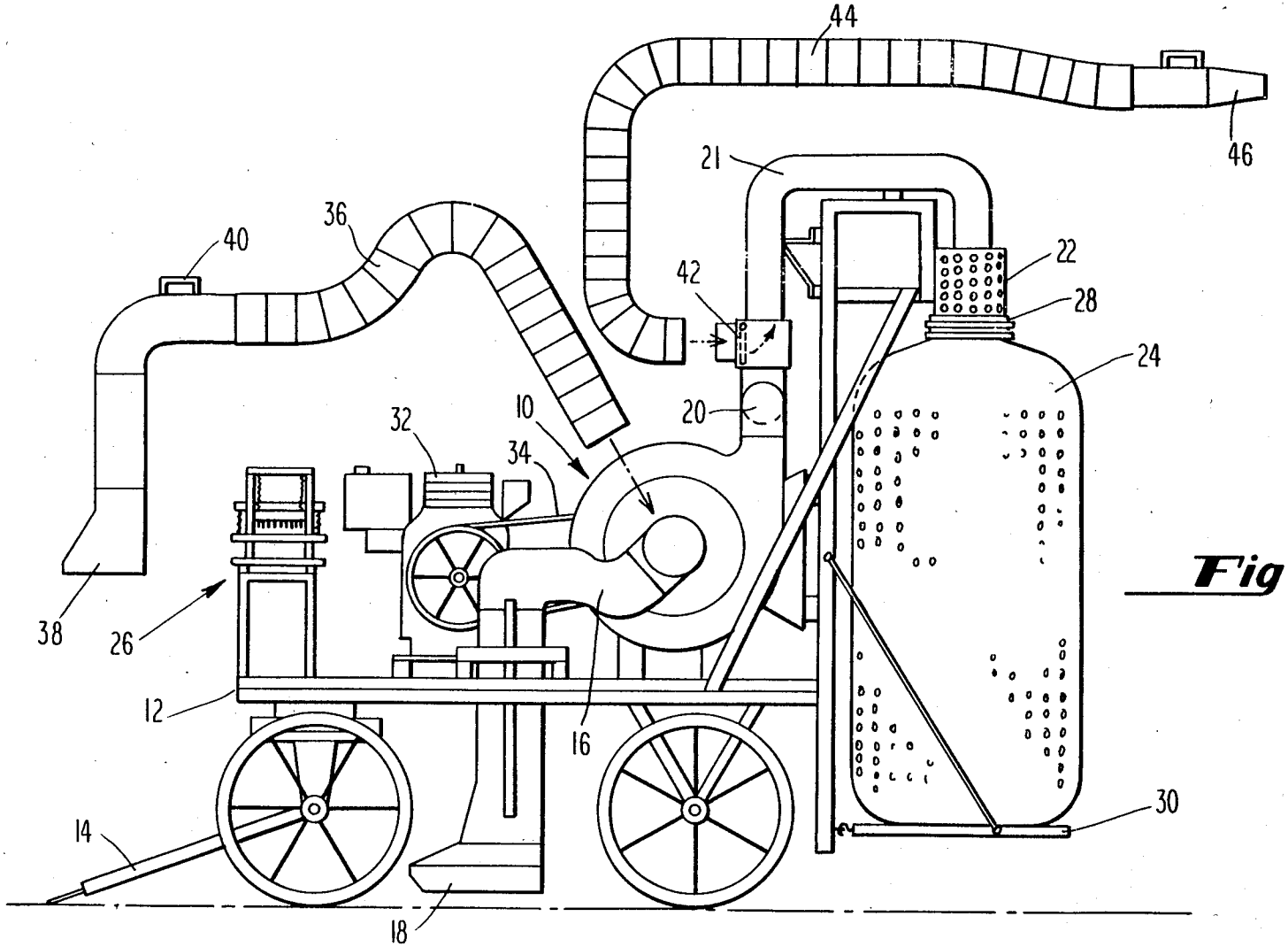
FIG. 1 represents a side view of the apparatus of the invention.

FIG. 1 shows a side view of the debris collection device according to the invention. A blower 10 is mounted on a wagon 12 to be towed by a tow bar 14 as needed. The input of the centrifugal blower is plumbed via duct 16 to an intake head 18 which defines an opening adjustable for height, typically adjusted to be on the order of one inch above the ground. The outlet of the blower 10 is plumbed by ducts 20 and 21 to a plenum 22 which may be provided with a plurality of holes as shown for depressurization and thence to a punched disposable bag 24. The bag 24 may be any of those commonly sold and referred to as trash bags, typically of 30 gallons capacity or more, made of a 1 to 2 mil. layer of plastic sheet such as polyethylene. Paper bags could also be used. The perforations shown are necessary so that the pressurized air stream in which the leaves and debris are entrained can escape from the bag, so that it can be filled with leaves. The holes in the plenum 22 also have value; in a prototypical version of this device these holes lower the pressure sufficiently that the bag is not stretched excessively due to the escape of the air through the perforations. In the design shown, the bag is beneath the outlet port of the plenum, so that by the time the air stream with its entrained debris reaches the plenum 22, the leaves fall vertically downward into the bags, partially under the influence of gravity, so that the air stream can largely be dissipated at the plenum 22 without interference with the disposal function. The holes in the plenum 22 also permit escape of the pressurized air when the holes in the bag have been largely obscured by debris in the bag.

As will be appreciated, disposable bags 24 are not typically sold with perforations in them. Accordingly, in the preferred embodiment of the device, a perforating punch 26 is also provided which is discussed below in connection with FIG. 2. It will be possible, of course, to have this punch mounted elsewhere, in a garage or the like, and to punch a quantity of bags before beginning a debris collection operation. However, as is known, these bags are typically supplied packed very compactly in a cardboard package and to prepunch a number of them would mean that they would have to be stored, at some inconvenience, until they were used. Accordingly, it is deemed desirable in the preferred embodiment to put the punch right on the machine such that the bags may be punched as needed.

In the preferred embodiment, a groove 28 is formed around the mouth of the plenum 22, and a bag 24 is secured thereto by stretching elastic cord around the bag in the groove so as to retain the bag thereon. The weight of the bag full of leaves is supported by a shelf 30 which may be provided with height adjustment to accommodate a wide variety of commonly available bag sizes. In the successfully tested embodiment, the blower used was a Model No. 9 Cincinnati Fan and Ventilating Company paddle wheel centrifugal blower. It was driven by a Tecumseh five-horsepower gasoline engine 32, driving through a belt 34 with pulleys such that the fan speed was approximately 2.25 times engine speed. This blower provides a "chopping" effect to leaves, so that the leaves are mulched as they are placed into bags; this is useful in preparing mulch for flower beds and the like. The ducting 16, 20 and 21 includes 4 ½ and 5 inch industrial hose as needed to mate with the intake and exhaust port dimensions of blower 10.

As mentioned above, a number of the prior art devices do not get as much use out of the machinery they involve as possible. This situation is addressed by the present invention by making the ducting 16 detachable from the blower 10 such that a flexible duct 36 comprising a movable, hand operable intake hood 38 can be provided on the intake side as shown, so that one can simply leave the wagon mounted blower and collector stationary, and, holding a handle 40 affixed to the portable intake hood, pick up debris from any area inaccessible by the wagon. Similarly, by closing a flapper valve 42 and connecting a flexible hose assembly 44 and nozzle 46 to the outlet of the blower, a portable blower of high capacity is provided, e.g. for blowing leaves across a lawn or out of flower beds, shrubbery and the like into convenient piles for easy collection.

Figure 2:
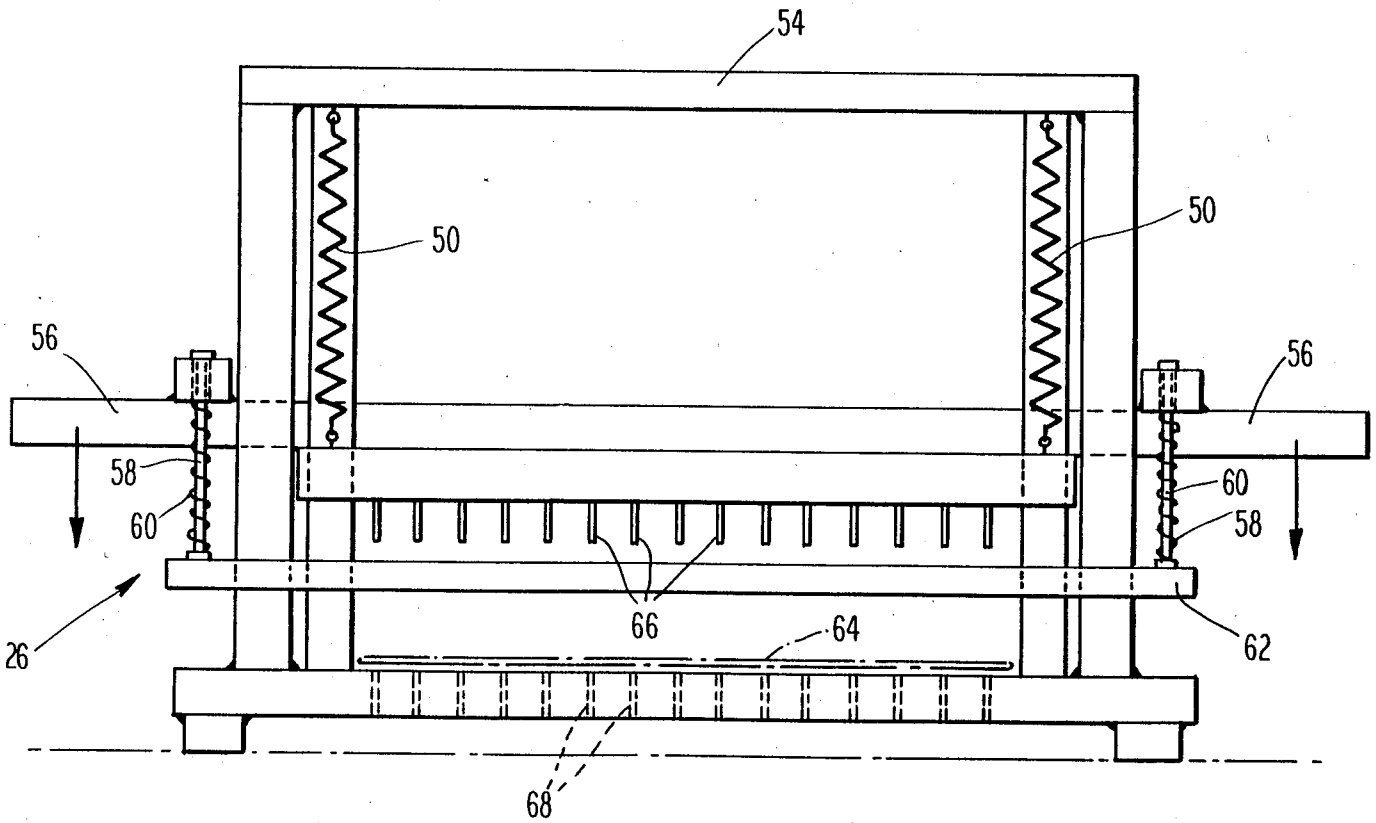
FIG. 2 shows a side view of the bag punch which in a preferred embodiment is mounted on the machine of FIG. 1.

FIG. 2 shows the bag punch 26 which, as discussed above, can be mounted on the machine permanently or installed at a workbench or similar location. Efficient punching of bags requires first that the bags be held still for the punch and second that the punch be enabled to punch a large number of holes at once, for convenience' sake. The design shown in FIG. 2 achieves these ends. A pair of suspension springs 50 support a sliding punch frame 52, carrying a number of punch dies 66, from a frame 54. The sliding frame 52 is moved by simultaneously pressing down on a pair of handles 56. A bag hold-down 62, which may simply be a wooden framework, is suspended from the sliding frame by bolts 58 surrounded by compression springs 60. Thus, in use, when a bag shown in phantom at 64 is placed under the punch dies 66 and the handles 56 are pushed down, first the hold down frame 62 engages the bag 64 to hold it steady, and then the dies 66 perforate the bag, extending into relief holes 68, opening up or punching out circular sections of the bag. In this way, a single motion of the hands on the handles 56 first holds down the bag and then performs the punching operation, all while ensuring that the operator is constrained to have both his hands out from under the punch dies 66, so that he does not injure himself inadvertently.

The punch shown in FIG. 2 can be easily assembled from standard items; the frame 54, the handle member 56, and the punch frame 52 can all be wooden, while the dies 66 can simply be 40-penny nails ground to sharp punch dies.

It will be appreciated that there are numerous modifications and improvements that can be made to the apparatus of the invention. In particular, while the apparatus has been shown as a self-contained, self-powered device mounted on a wagon for being towed by hand or by another vehicle, it would be possible to arrange the apparatus according to the invention to be carried by a tractor or the like. Similarly, the blower could be driven by the tractor motor. Therefore, the scope of the invention should not be restricted by the above exemplary embodiment but only by the following claims.

I claim:

1. A machine adapted to be mounted on wheels for the collection and disposal of leaves and other debris comprising:

a frame mounted on wheels for movement across the ground;

an enclosed fan mounted on said frame for developing a suction at an inlet port and a pressure at an outlet port;

an engine mounted on said frame for driving said fan;

an intake hood mounted on said frame;

a plenum mounted on said frame, said plenum having an inlet port and an outlet port;

piping means connecting said inlet port of said fan to said intake hood;

a non-enclosed disposable bag adapted to be supported on the vehicle and detachably secured to said outlet port of said plenum to receive the air and leaves and other debris passing therethrough, said disposable bag having a plurality of spaced holes therein whereby air can be exhausted from said bag without loss of leaves and other debris blowing thereinto; and said plenum having a number of holes therein for reducing air pressure in said plenum to lower the pressure sufficiently at said outlet port of said plenum so that said disposable bag is not stretched excessively by the air passing into said disposable bag in the absence of bag enclosing structure.

2. A machine according to claim 1 including flexible duct means having a hand operable auxiliary intake hood connected to one end thereof, and means for connecting the other end of said flexible duct means to said inlet port of said fan when said first-named piping means is disconnected from said inlet port of said fan to render said first-named intake hood inoperative.

3. A machine according to claim 1 or 2 including a flexible hose assembly adapted to be connected to said second-named piping means, and valve means associated with said second-named piping means for connecting said outlet port of said fan to said flexible hose assembly and for concurrently blocking flow of air from said outlet port of said fan to said inlet of said plenum whereby the flow of air from said fan is directed through said flexible hose assembly.

4. A machine adapted to be mounted on a vehicle for the collection and disposal of leaves and other debris comprising:

an enclosed fan mounted on the vehicle for developing a suction at an inlet port and a pressure at an outlet port;

an engine mounted on the vehicle for driving said fan;

an intake hood mounted on the vehicle;

a plenum vertically mounted on the vehicle, said plenum having an inlet port and an outlet port;

piping means connecting said inlet port of said fan to said intake hood;

piping means conecting said outlet port of said fan to said inlet port of said plenum;

means on said plenum adjacent said outlet port thereof for attachment of a disposable bag for containment of leaves and other debris;

a non-enclosed disposable bag adapted to be vertically supported on the vehicle and detachably secure to said outlet port at the bottom of said plenum to receive the air and leaves and other debris passing therethrough, said disposable bag having a plurality of spaced holes therein whereby air can be exhausted from said bag without loss of leaves and other debris blowing thereinto; and said plenum having a number of holes therein for reducing air pressure in said plenum to lower the pressure sufficiently at said outlet port of said plenum so that said disposable bag is not stretched excessively by the air passing into said disposable bag in the absence of bag enclosing structure.

* * * * *